US005402718A

United States Patent [19]

Rigodiat

[11] Patent Number: 5,402,718

[45] Date of Patent: Apr. 4, 1995

[54] TURNTABLE TYPE PRINTING MACHINE

[75] Inventor: Pierre Rigodiat, Noisy Le Grand, France

[73] Assignee: Societe D'Exploitation des Machines Dubuit, Noisy Le Grand, France

[21] Appl. No.: 148,503

[22] Filed: Nov. 8, 1993

[30] Foreign Application Priority Data

Dec. 11, 1992 [FR] France ..... 92 14927

[51] Int. Cl.[6] ..... B41L 13/00; B41N 1/24

[52] U.S. Cl. ..... 101/126; 101/114; 101/115; 101/123

[58] Field of Search ..... 101/114, 115, 123, 124, 101/126, 127, 127.1

[56] References Cited

U.S. PATENT DOCUMENTS

| | | | |
|---|---|---|---|
| 3,388,658 | 6/1968 | Cummings | 101/38 |
| 4,099,460 | 7/1978 | Bubley et al. | 101/115 |
| 4,753,162 | 6/1988 | Bubley | 101/115 |
| 5,092,239 | 3/1992 | Bubley | 101/115 |
| 5,129,155 | 7/1992 | Hoffman et al. | 101/115 |
| 5,154,119 | 10/1992 | Fuqua et al. | 101/123 |
| 5,158,016 | 10/1992 | Dubuit | 101/123 |
| 5,165,340 | 11/1992 | Karlyn et al. | 101/126 |

FOREIGN PATENT DOCUMENTS 8700806 4/1987 Germany .

OTHER PUBLICATIONS

Patent abstracts of Japan vol. 10, No. 238 (M-508) (2294) Aug. 16, 1986.

*Primary Examiner*—Edgar S. Burr
*Assistant Examiner*—Lynn D. Hendrickson
*Attorney, Agent, or Firm*—Young & Thompson

[57] ABSTRACT

A printing machine comprises a turntable carrying a plurality of object supports in a circular arrangement, at least one of which object supports is adjustable in position on said turntable perpendicularly thereto. The printing machine may be a silkscreen printing machine, for example.

18 Claims, 1 Drawing Sheet

TURNTABLE TYPE PRINTING MACHINE

BACKGROUND OF THE INVENTION

1. Field of the Invention

The present invention is generally concerned with printing machines of the kind using a turntable rotatable about an axis perpendicular to its plane and to which a plurality of spaced object supports are attached in a circular arrangement.

It is more particularly, although not necessarily exclusively, directed to the situation in which flat objects such as disks must be printed on a plane surface perpendicular to the rotation axis of the turntable.

2. Description of the Prior Art

The object supports currently used are attached directly to the turntable.

If there is a suction head under each object support for holding the supported object there is merely a seal between each support and the turntable.

The suction head is attached to the turntable.

In the case of printing in more than one color the diameter of the turntable is proportional to the number of colors to be printed because as many printing heads and curing ovens are required on the path of the object supports as there are colors to be applied.

Given the inevitable machining tolerances it is then extremely difficult, if not impossible, to achieve sufficient flatness of the turntable perpendicular to its rotation axis, by which is meant a flatness within tolerances closer than 0.2 mm.

Consequently, the level of the printing surface is not strictly identical for all the object supports as they are fed under a printing head but to the contrary may vary from one object support to the next all around the turntable.

In the case of silkscreen printing of simple designs in only one color the pressure exerted by the squeegee on the screen and therefore through the screen on the objects to be printed is usually sufficient to compensate for these slight departures of the turntable from perfect flatness, given the capacity for deformation of the screen.

Thus in practise these defects are of no consequence in this case.

The same cannot be said in respect of multicolor printing.

In this case the various transparent colors employed must be printed one on top of the other.

The pressure of the squeegee depends on their thickness and therefore on their color intensity.

To obtain the same shade reliably for all the printed objects it is essential for the squeegee pressure to be the same from one object support to the next. In other words, the respective printing surfaces must be at exactly the same level relative to the path of the squeegee for all the object supports.

A general object of the present invention is an arrangement whereby this requirement can be satisfied in a simple and reliable manner.

SUMMARY OF THE INVENTION

The present invention consists in a printing machine comprising a turntable carrying a plurality of object supports in a circular arrangement, at least one of which object supports is adjustable in position on said turntable perpendicularly thereto.

In one preferred embodiment of the invention, for example, said object support rests on at least one adjuster screw in screwthreaded engagement with and passing through said turntable and is attached to said turntable by at least one fixing member separate from said adjuster screw and spaced therefrom.

For each object support there may be three adjustment screws in a triangle and two fixing members.

Individual adjustment of the object supports has the advantage that the respective printing surfaces can be levelled independently of turntable manufacturing tolerances and object support manufacturing tolerances.

As a result, at any printing head, the printing surface is always at exactly the same level for all the object supports, avoiding any variation in squeegee pressure from one object support to the next with the result that all of the objects printed can be printed exactly the same color to achieve a perfect and consistent finish.

The features and advantages of the invention will emerge from the following description given by way of example with reference to the appended diagrammatic drawings.

DETAILED DESCRIPTION OF THE INVENTION

Figure 2:
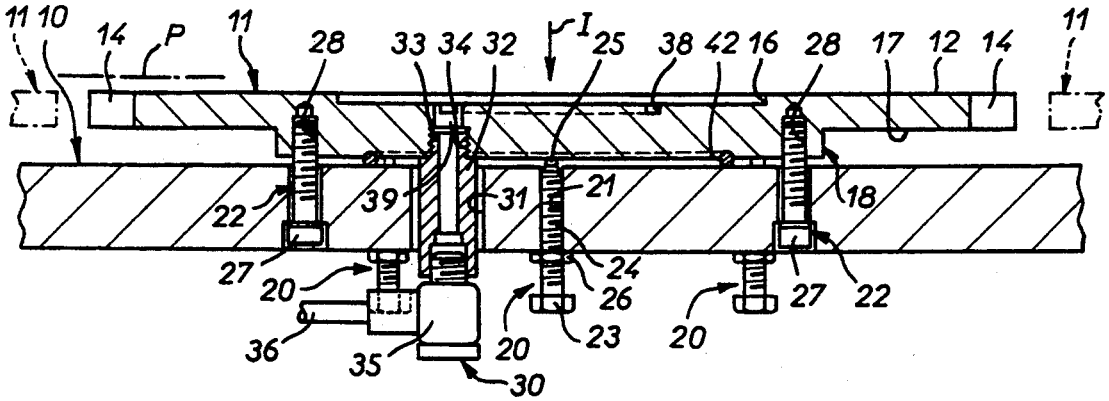
FIG. 2 is a view of this part of the machine in transverse cross-section on the line II—II in FIG. 1.
Figure 1:
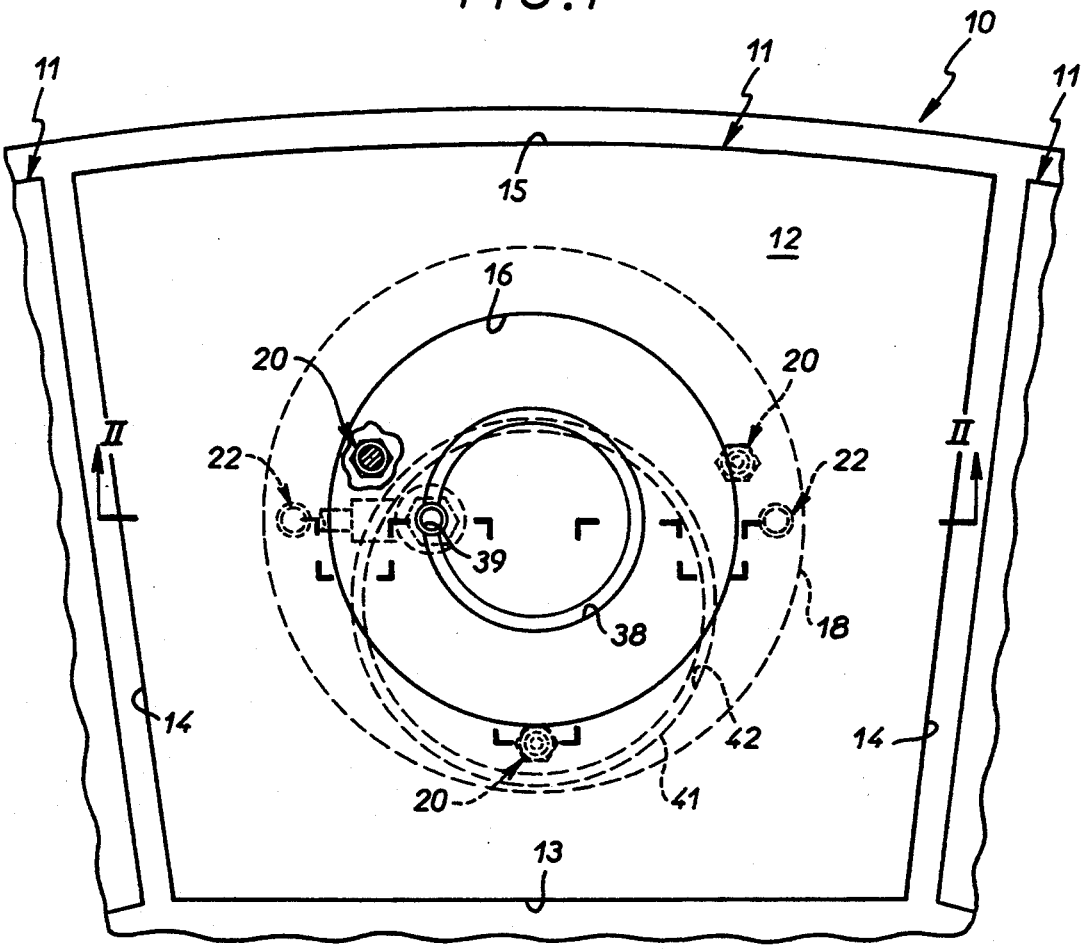
FIG. 1 is a plan view of part of a printing machine in accordance with the invention as seen in the direction of the arrow I in FIG. 2.

This printing machine in accordance with the invention, which is a silkscreen printing machine, includes a circular turntable 10 rotatable about an axis perpendicular to its plane to which a plurality of spaced object supports 11 are attached in a circular arrangement in order to feed the object supports 11 under one or more printing heads (not shown) each of which is usually followed by a curing oven (also not shown).

The figures show only part of the turntable 10 and only one of the object supports 11, although this is shown in its entirety.

The figures show only the component parts of the machine necessary to understand the invention.

An object support 11 has a trapezium-shape contour at its upper surface 12 with a straight shorter side 13 perpendicular to the radius of the turntable 10 passing through its central region, two sides 14 along radii of the turntable 10 and a curved longer side 15 concentric with the turntable 10.

To receive an object to be printed, a disk (not shown) in this example, it has a circular housing 16 recessed into its upper surface 12. A perforated blanket (also not shown) is usually inserted in this housing before an object to be printed.

A circular base 18 coaxial with the housing 16 projects from the lower surface 17 of each object support 11.

According to the invention at least one of the object supports 11 carried by the turntable 10 (each of them in practise) is adjustable in position on the turntable 10 perpendicular to it, i.e. perpendicularly to its plane.

Each object support 11 rests on at least one adjuster screw 20 which is screwed into a screwthreaded hole 21 provided for this purpose in the turntable 10. The adjuster screw extends completely through the turntable 10. Each object support 11 is attached to the turntable 10 by at least one fixing member 22 separate from the adjuster screw 20 and at a distance from the latter.

Here three adjuster screws 20 are arranged in a triangle and the base 18 of the object support 11 rests on them.

For manufacturing reasons the barycenter of the triangle in which the adjuster screws 20 are arranged is slightly offset from the center of the base 18.

The adjuster screws 20 have a fine thread.

Each has a head 23 accessible from below the turntable 10, a threaded shank 24 screwed into the respective threaded hole 21 in the turntable 10 and an end-piece 25 coaxial with the threaded shank 24 and on the end of which the object support 11 rests.

A locknut 26 is screwed onto the threaded shank 24 of the adjuster screw 20 below the turntable 10.

Two fixing members 22 are provided.

They are disposed along a straight line parallel to one side of the triangle defined by the adjuster screws 20 are arranged, between the one side and the opposite apex of the triangle, the fixing members being disposed on respective sides of the triangle.

They are screws with their head 27 bearing against the lower side of the turntable 10 through which they pass freely to be screwed into threaded holes 28 provided for this purpose in the lower side 17 of the respective object support 11.

These threaded holes 28 are in the base 18 of the object support 11.

A suction head 30 is associated with each object support 11.

It is attached to the object support 11, passing with clearance through the turntable 10 by means of a hole 31 provided for this purpose in the turntable 10.

The suction head 30 has a hexagonal outside contour shank 32 with a screwthreaded end-piece 33 screwed into a screwthreaded bore 34 provided for this purpose in the base 18 of the object support 11 and, at right angles to the shank 32, an end-piece 35 which is screwed to the shank 32 and to which is connected a hose 36 for connecting the suction head to a suction pump (not shown).

The suction head 30 communicates with a circular groove in the bottom of the housing 16 of the object support 11.

The suction head 30 discharges into a chamber 39 which the groove 38 intersects.

Spring means are disposed in a circular arrangement between the object support 11 and the turntable 10.

The spring means comprise an O-ring 41 which is held in place by virtue of the fact that at least part of it is engaged in a circular groove 42 in the lower surface of the base 18 of the object support 11.

For manufacturing reasons the groove 42 is off-center relative to the base 18 in which it is formed.

The threaded bore 34 into which the shank 32 of the suction head 30 is screwed is preferably inside the contour of the groove 42.

The adjuster screws 20 of an object support 11 are turned so that regardless of the flatness of the turntable 10 and regardless of the manufacturing tolerances of the object support 11 the printing surface for the object support 11 is in a plane P shown in chain-dotted line in FIG. 2 and so that this plane P is perpendicular to the rotation axis of the turntable 10.

The object support 11 may then be inclined or rocked to a greater or lesser degree relative to the turntable 10, such inclination being allowed by the clearance with which the shank 32 of the suction head 30 passes through the turntable 10.

The adjustments are naturally such that the plane P is the same for all the object supports 11.

When the object supports 11 have been adjusted in position in this way their adjuster screws 20 are locked against the turntable 10 by the locknuts 26 and they are immobilized relative to the turntable 10 by their fixing members 22, crushing the O-rings 41 underneath them.

The present invention is naturally not limited to the embodiment described and shown but encompasses any variant execution thereof.

There is claimed:

1. Printing machine comprising a turntable having an axis of rotation and carrying a plurality of object supports in a circular arrangement, each of said object supports defining a printing surface, the improvement comprising mounting means for rockably mounting at least one of the object supports on the turntable, and adjusting means separate and distinct from said mounting means for adjusting the inclination of the at least one object support relative to the turntable so that the printing surface is perpendicular to the axis of rotation of the turntable, said mounting means comprising at least one fastener member and said adjusting means comprising at least one adjuster member in engagement with and extending through the turntable and bearing against the at least one object support.

2. Printing machine according to claim 1, wherein the at least one adjuster member comprises three adjuster screws arranged in a triangular array and in threaded engagement with the turntable.

3. Printing machine according to claim 1, wherein said at least one fastener member extends freely through the turntable and is fixed to the object support.

4. Printing machine according to claim 2, wherein said at least one fastener member comprises at least one screw freely extending through the turntable and is in threaded engagement with the at least one object support.

5. Printing machine according to claim 1, wherein there are three said adjuster members arranged in a triangular array, and two said fastener members are disposed in a straight line parallel to one side of the triangular array and located outwardly beyond each of the other two sides of the array.

6. Printing machine according to claim 1, wherein a suction head is attached to the at least one object support for applying suction thereto, said suction head extending with clearance through the turntable.

7. Printing machine according to claim 6, wherein said suction head is in communication with a groove defined in the at least one object support opening on to the support surface.

8. Printing machine according to claim 1, wherein each said object support has a said mounting means and a said adjusting means.

9. Printing machine according to claim 1, wherein spring means is engaged between said turntable and said object support and is compressible in response to displacement of said adjusting means to adjust the position of the object support.

10. Printing machine comprising a turntable having an axis of rotation and carrying a plurality of object supports in a circular arrangement, each of said object supports defining a printing surface, the improvement comprising mounting means for mounting at least one of the object supports on the turntable so as to admit of relative movement, and adjusting means separate and spaced from said mounting means for adjusting the inclination of the at least one object support relative to the turntable so that the printing surface is perpendicular to the axis of rotation of the turntable, said mounting means comprising at least one fastener member and said adjusting means comprising at least one adjuster member in engagement with and extending through the turntable and bearing against the at least one object support.

11. Printing machine according to claim 10, wherein the at least one adjuster member comprises three adjuster screws disposed in a triangular array and in threaded engagement with the turntable.

12. Printing machine according to claim 10, wherein at least one fastener member extends freely through the turntable and is fixed to the object support.

13. Printing machine according to claim 11, wherein said at least one fastener member comprises at least one screw freely extending through the turntable and in threaded engagement with the at least one object support.

14. Printing machine according to claim 10, wherein there are three said adjuster members disposed in a triangular array, and two said fastener members disposed in a straight line parallel to one side of the triangular array and located outwardly beyond each of the other two sides of the array.

15. Printing machine according to claim 10, wherein a suction head is attached to the at least one object support for applying suction thereto, said suction head extending with clearance through the turntable.

16. Printing machine according to claim 15, wherein said suction head is in communication with a groove defined in the at least one object support and opening on to the printing surface.

17. Printing machine according to claim 10, wherein each said object support has a said mounting means and a said adjusting means.

18. Printing machine according to claim 10, wherein spring means is engaged between said turntable and said object support and is compressible in response to displacement of said adjusting means to adjust the position of the object support.

* * * * *